US005732878A

United States Patent [19]

Schroder et al.

[11] Patent Number: 5,732,878

[45] Date of Patent: Mar. 31, 1998

[54] SECURE CURRENCY DEPOSIT SYSTEM HAVING MULTIPLY ACCESSIBLE CASH CASSETTE

[75] Inventors: John Sherman Schroder; Daniel J. Banyas; Mark Hollinrake, all of Cedar Rapids, Iowa

[73] Assignee: Lefebure Manufacturing Corporation, Cedar Rapids, Iowa

[21] Appl. No.: 658,617

[22] Filed: Jun. 5, 1996

[51] Int. Cl.[6] ..... B65D 91/00

[52] U.S. Cl. ..... 232/1 D; 232/15; 232/43.2; 109/53; 109/66

[58] Field of Search ..... 232/43.2, 1 D, 232/15, 16; 109/53, 66

[56] References Cited

U.S. PATENT DOCUMENTS

| | | | |
|---|---|---|---|
| 1,647,275 | 11/1927 | Cursons | 232/15 |
| 3,292,849 | 12/1966 | Ewing | 232/1 D |
| 3,433,185 | 3/1969 | Roberts | 232/15 |
| 3,741,464 | 6/1973 | Verbeke | 232/15 |
| 3,948,376 | 4/1976 | Roman | 232/15 X |
| 4,370,006 | 1/1983 | Graef et al. | 232/15 X |
| 4,491,269 | 1/1985 | Sweazey et al. | 232/1 D |

*Primary Examiner*—Blair Johnson

*Attorney, Agent, or Firm*—Lathrop & Gage, L.C.

[57] ABSTRACT

A secure currency deposit system having a cabinet with one or more compartments, each for containing a cassette wherein each cassette has an openable front wall, a cavity, and a slotted upper panel for receiving currency therethrough. Each of the cassettes has a locking arrangement to selectively permit insertion access to its slotted upper panel. Associated with each of the compartments is another locking arrangement which, in conjunction with the cassette locking arrangement and an unlatching arrangement, selectively permits contents removal access to the cavity of the respective cavity and, in conjunction with a latching arrangement, selectively permits removal of the respective cassette from the respective compartment. Each cassette has dividers partitioning its cavity into a plurality of bins. Each cassette may be removable from, or semi-permanently installed in, the respective compartment.

14 Claims, 4 Drawing Sheets

Fig.1.
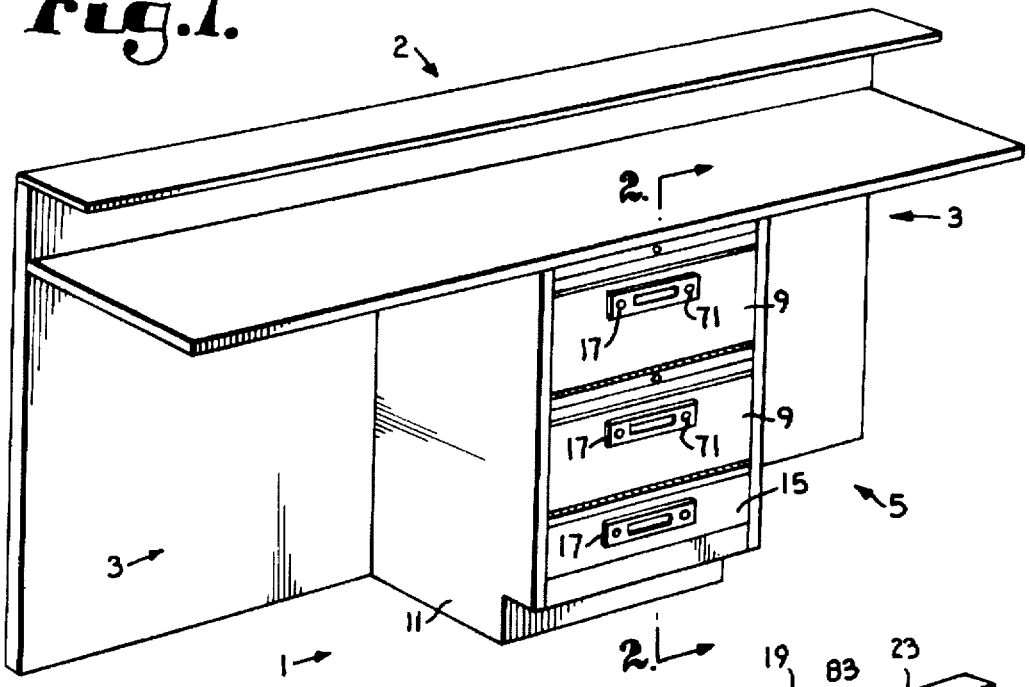
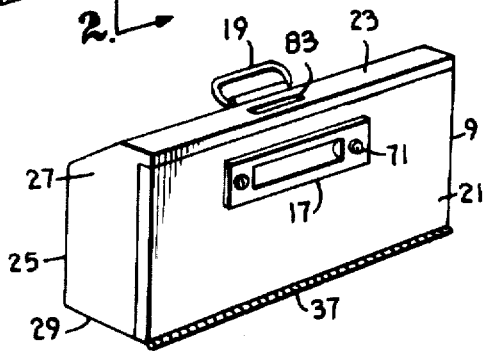
Fig.11.
Fig.5.
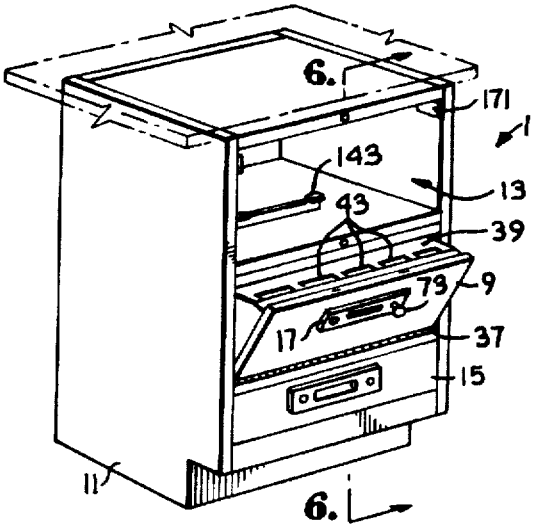
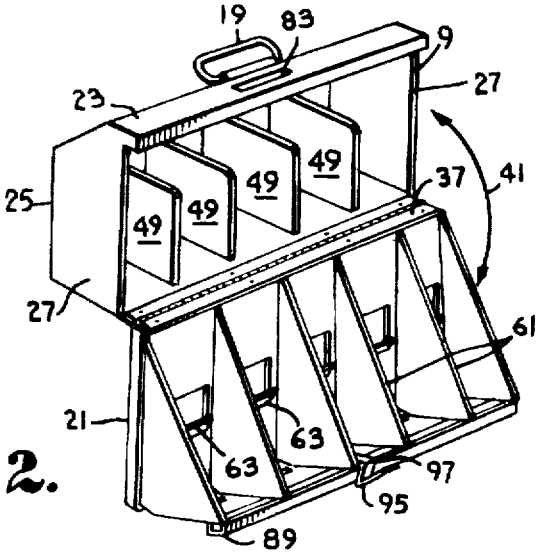
Fig.12.

Fig.8.
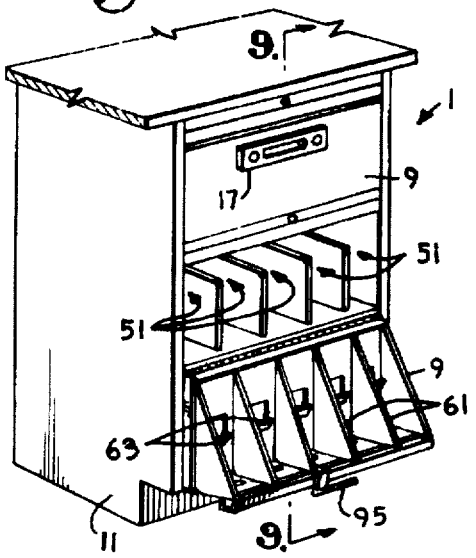
Fig.2.
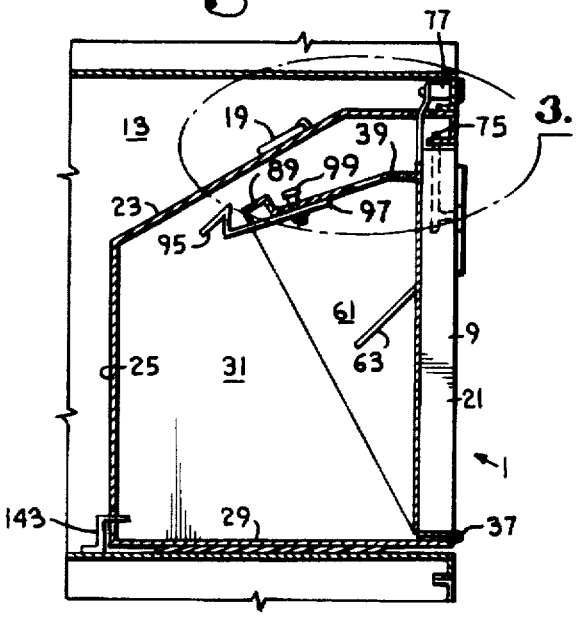
Fig.6.
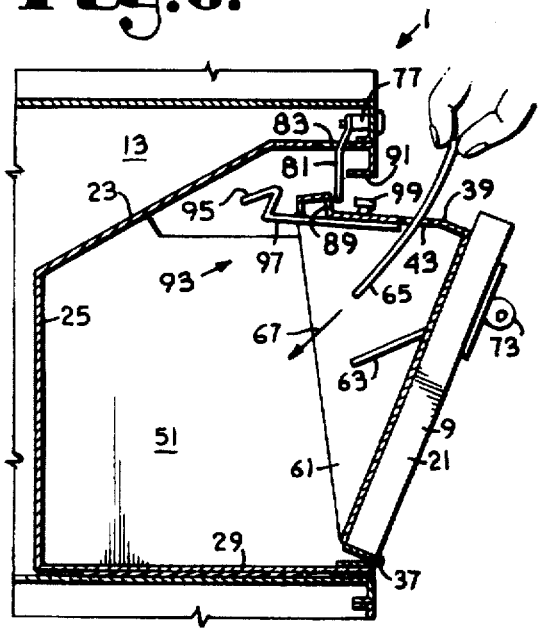
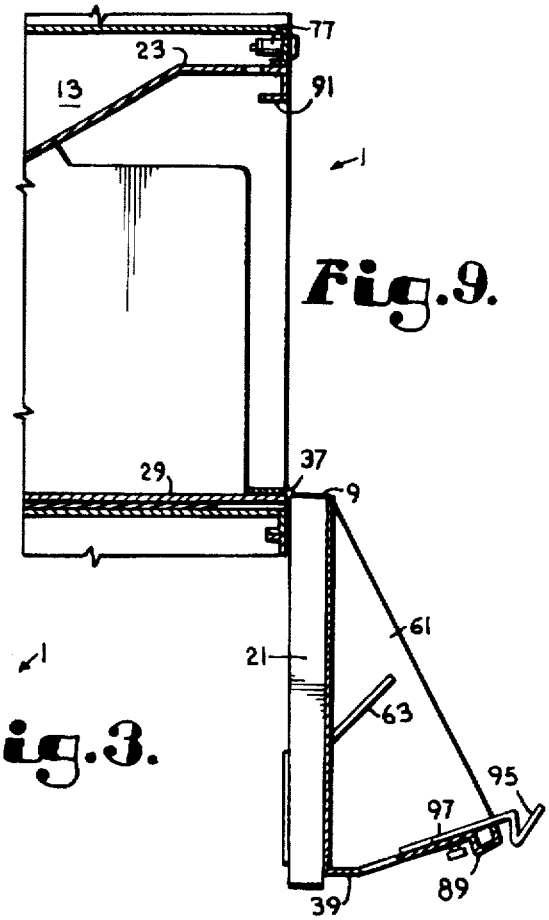
Fig.9.
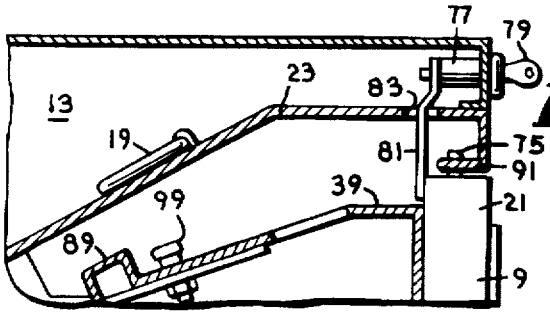
Fig.3.

Fig. 16.
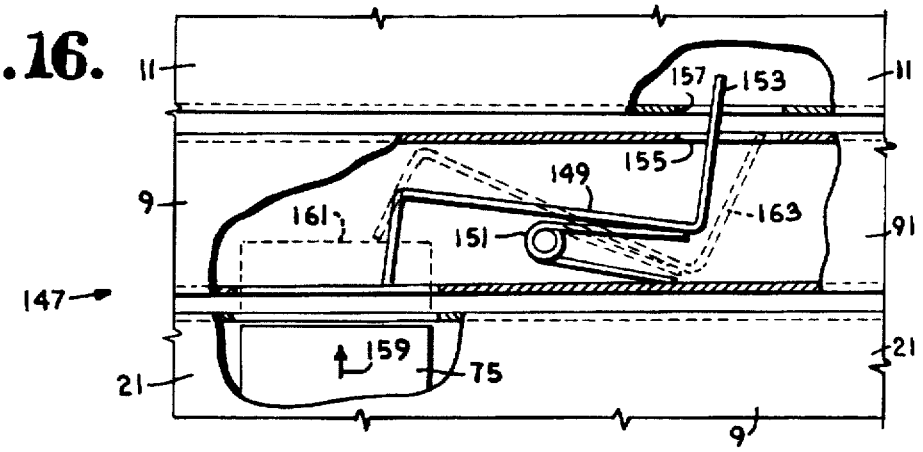
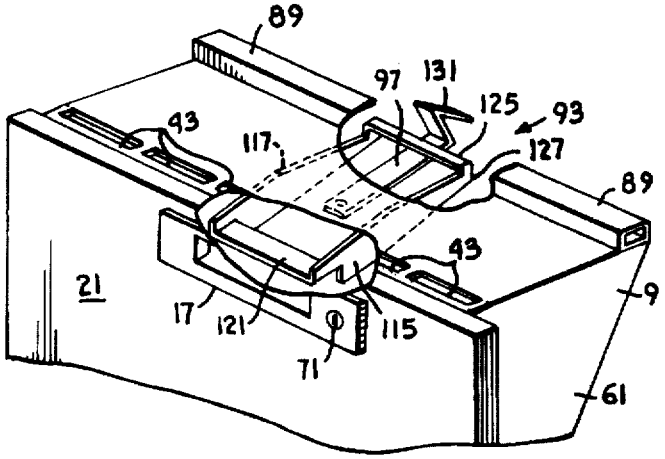
Fig. 14.
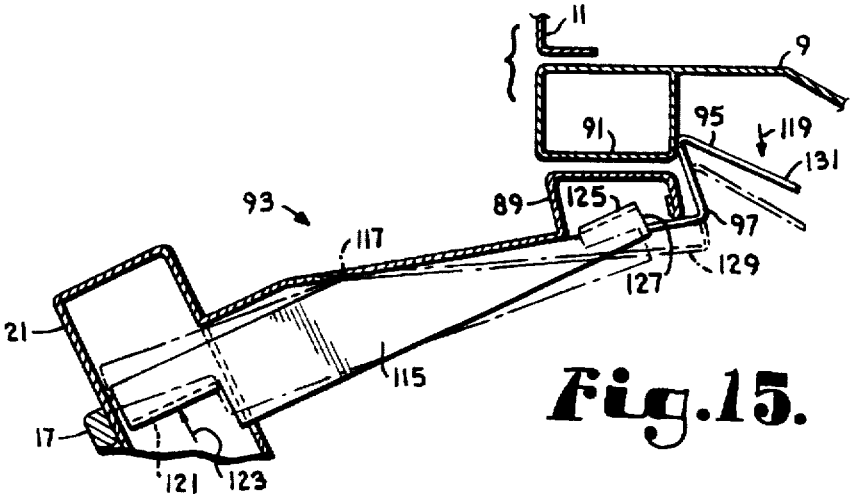
Fig. 15.

SECURE CURRENCY DEPOSIT SYSTEM HAVING MULTIPLY ACCESSIBLE CASH CASSETTE

BACKGROUND OF THE INVENTION

1. Field of the Invention

This invention relates generally to temporary currency storage units, as used in banks or other currency transaction businesses.

2. Description of the Related Art

Commercial establishments which handle substantial sums of money are, of course, concerned about protecting current holdings of cash or similar negotiable instruments from being mishandled or stolen. Efficiency of banking and other cash handling operations necessitate that cash receipts be expeditiously stored in a manner wherein they can be transferred to a central secure storage safe or vault at a later time, such as after closing hours or during shift changes, and readily accounted for in a convenient and secure environment.

It is known to mount a security box beneath a cashier's counter in order to hide the security box from public view. No large deposits would generally be retained at a cashier's work station for extended periods beyond normal business hours. However, during deposits and for purposes of transfer, selective access to the currency deposit unit is generally necessary. To alleviate a need to open a known type security box to deposit funds, the security box has been furnished with a slot or slots for depositing currency.

It is further known to deposit money through a slot in a table surface which slot coincides with a similar slot in the removable security box mounted within a mounting frame to the traderside of the table. Efforts have also been made to prevent tampering with security boxes, such as shown in U.S. Pat. No. 3,292,849, wherein closure of a slot in a security box occurs upon removal of the security box from a deposit position beneath a mounting table.

U.S. Pat. No. 3,433,185 pertains to a similar security box installation wherein a security box is mounted under a table in order to receive currency deposited through a slot in the table. The disclosed security box also has a protective slide for a currency slot. Protecting the security boxes tampering may be of less concern in establishments wherein the person depositing funds into the security box works in the vicinity of the location of the security box and is accountable for the funds.

However, various types of commercial establishments which handle substantial sums of money may require protection from walk-in robberies in day-to-day operations. Since robberies are generally crimes of convenience, protection may be available by providing temporary inaccessibility of the spoils of such crimes. Properly designed security boxes may serve such a need by delaying immediate access to currency stored therein. On the other hand, persons working in such establishments must also be able to handle currency in a commercially efficient manner so as to minimize handling costs. Thus, the use of a security box must not interfere with sorting of cash receipts.

What is needed is a secure system providing different types of accessability thereto, such as insertion access for inserting currency therein but not for removing currency therefrom, and joint access for contents removal access for jointly removing currency from a compartment thereof.

SUMMARY OF THE INVENTION

An improved secure system is provided for depositing currency in a multiply accessible compartment therein. The secure system includes one or more enclosed cassettes, each having an openable front wall, a cavity, and a slotted upper panel configured to operatively receive currency therethrough to be deposited in the cavity; and a cabinet having a separate compartment for receiving a respective one of the cassettes therein.

Each of the cassettes has a cassette locking arrangement configured to selectively lock the front wall of the respective cassette, each cassette locking arrangement having a locked configuration wherein insertion access to the respective slotted upper panel is prevented and an unlocked configuration wherein insertion access to the respective slotted upper panel is permitted. Associated with each of the compartments of the cabinet is a cavity locking arrangement configured to selectively lock the cavity of the cassette received in the respective compartment, each cavity locking arrangement having a locked configuration wherein contents removal access to the respective cavity is prevented and an unlocked configuration wherein contents removal access to the respective cavity is permitted.

Each of the cavity locking arrangements is also configured to prevent removal of the respective cassette from the respective compartment as the cavity locking arrangement assumes its locked configuration and to permit removal of the respective cassette from the respective compartment as the cavity locking arrangement assumes its unlocked configuration.

The secure system also includes latching arrangement for each of said cassettes for selectively latching the respective cassette in the respective compartment of the cabinet. The latching arrangement has a latched configuration wherein the latching arrangement is configured to prevent removal of the respective cassette from the respective compartment as the cassette locking arrangement assumes its unlocked configuration and an unlatched configuration wherein the latching arrangement is configured to permit removal of the respective cassette from the respective compartment as the cassette locking arrangement assumes its locked configuration.

The secure system also includes an unlatching arrangement configured to selectively unlatch the front wall such that contents removal access to the cavity is permitted as the cavity locking arrangement assumes its unlocked configuration. The unlatching arrangement includes a resilient latch and a release configured to selectively unlatch the resilient latch. The release may comprise a release button or, alternatively, a lever arrangement associated with a recessed handle in the front wall of the respective cassette.

Each of the cassettes generally includes a plurality of internal partitions dividing the cassette into a plurality of internal bins, each bin being associated and aligned with a respective slot in the respective upper panel.

Any or all of the cassettes may be selectively removable from, or semi-permanently installed in, its respective compartment.

PRINCIPAL OBJECTS AND ADVANTAGES OF THE INVENTION

The principal objects and advantages of the present invention include: providing a secure currency deposit system having one or more multiply accessible cash cassettes; providing such a secure currency deposit system wherein a user has independent insertion access thereto such that currency may be deposited within the secure currency deposit system; providing such a secure currency deposit system wherein a user having such insertion access does not have independent contents removal access thereto wherein currency deposited therein could be removed; providing such a secure currency deposit system having a removable cash cassette wherein a user having insertion access cannot independently remove the cash cassette; providing such a secure currency deposit system having a removable cash cassette that cannot be removed as insertion access is being provided to a user; providing such a secure currency deposit system having two removable cash cassettes; and generally providing such a secure currency deposit system which is economical to manufacture, efficient in operation, reliable in performance, capable of long operating life and particularly well adapted for the proposed usage thereof.

Other objects and advantages of the present invention will become apparent from the following description taken in conjunction with the accompanying drawings, which constitute a part of this specification and wherein are set forth exemplary embodiments of the present invention to illustrate various objects and features thereof.

BRIEF DESCRIPTION OF THE DRAWINGS

FIG. 1 is a perspective, front elevational view of a secure currency deposit system having a pair of multiply accessible cash cassettes spaced over a drawer, according to the present invention.

FIG. 2 is an enlarged and fragmentary, cross-sectional view of one of the multiply accessible cash cassettes of the secure currency deposit system, taken along line 2—2 of FIG. 1.

FIG. 3 is a fragmentary, cross-sectional view of one of the multiply accessible cash cassettes, further enlarged from detail 3 of FIG. 2, showing a cavity locking arrangement of the secure currency deposit system in a locked configuration.

FIG. 5 is a perspective view of the secure currency deposit system, similar to that shown in FIG. 1 but showing one of the multiply accessible cash cassettes removed therefrom and another one of the cash cassettes opened to allow access to a slotted upper panel of the cash cassette.

FIG. 6 is an enlarged and fragmentary, cross-sectional view of one of the multiply accessible cash cassettes taken along line 6—6 of FIG. 5, similar to that shown in FIG. 2 but showing currency being inserted through the slotted upper panel of the respective cash cassette of the secure currency deposit system.

FIG. 8 is a perspective view of the secure currency deposit system, similar to that shown in FIG. 5 but showing one of the multiply accessible cash cassettes opened to allow contents removal access to the cash cassette.

FIG. 9 is an enlarged and fragmentary, cross-sectional view of one of the multiply accessible cash cassettes taken along line 9—9 of FIG. 8, similar to that shown in FIG. 6 but showing a front wall of the cassette opened to allow contents removal access to the cash cassette.

FIG. 11 is a fragmentary and perspective view, enlarged from the scale of FIG. 1, showing one of the multiply accessible cash cassettes removed from the secure currency deposit system.

FIG. 12 is a fragmentary and perspective view of one of the multiply accessible cash cassettes removed from the secure currency deposit system, similar to that shown in FIG. 11 but showing the cash cassette opened to allow contents removal access to the cash cassette.

FIG. 14 is an enlarged and fragmentary, perspective view of the secure currency deposit system, showing portions cut away to reveal details of an unlatching means thereof.

FIG. 15 is a further enlarged and fragmentary, partially cross-sectional view of the unlatching means of the secure currency deposit system, showing a latched configuration thereof in solid lines and an unlatched configuration thereof in phantom lines.

FIG. 16 is a still further enlarged and fragmentary, partially cross-sectional view of the secure currency deposit system, showing portions cut away to reveal details of a latching means, with the latching means shown in a latched configuration in solid lines and in an unlatched configuration in phantom lines, according to the present invention.

DETAILED DESCRIPTION OF THE INVENTION

Figure 4:
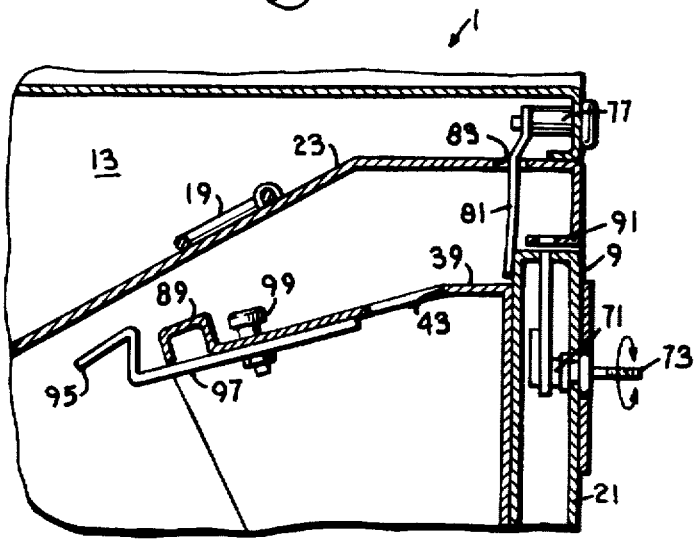
FIG. 4 is a further enlarged and fragmentary, cross-sectional view showing a front wall of one of the multiply accessible cash cassettes and a cassette locking arrangement of the secure currency deposit system assuming an unlocked configuration.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a secure currency deposit system in accordance with the present invention, as shown in FIGS. 1 through 16. Among other applications, the system 1 may be used as part of a cashier's work station 2 as it may be found in a banking facility or at a cashier's station in certain business establishments providing services requiring handling of currency. The work station 2 may provide facilities for more than one user and may be a sit-down unit with knee spaces 3.

The system 1 generally includes container means 5, such as a cabinet 11 or other suitable enclosure, that is generally configured to contain one or more cassettes 9, each in a respective compartment 13 thereof, and a drawer 15 arranged in vertical relationship therewith, as shown in FIG. 1. It is to be understood that the drawer 15 may be positioned above, below or between the one or more cassettes 9. The cash cassettes 9 are necessarily located to be readily accessible by a person or persons working at the cashier's work station 2. The drawer 15 generally includes dividers for check receipts, various banking transaction and other cash accounting forms, coinage and the like, as may be used by a cashier or bank teller during normal business operations. Preferably, the cabinet 11 and the cassettes 9 are constructed of steel or other suitable material having reasonable strength and resistance to forced entry.

The one or more cassettes 9 and the drawer 15 generally have matching recessed pulls 17, such as those shown in FIG. I for example, to provide the cassettes 9 with the appearance of being just more drawers in the cabinet 11. Each of the one or more cassettes 9 may have a handle 19, such as a bail as shown in FIG. 19, to assist a user carrying the respective cassette 9.

Each of the cassettes 9 are generally configured with a front wall 21, a top wall 23, a back wall 25, opposing end walls 27, and a bottom wall 29, enclosing an interior cavity 31 therein. A preferred embodiment of each of the cash cassettes 9 has a front-to-rear cross-sectional shape that can be generally described as trapezoidal; the cross-sectional shape, however, is not critical to the invention.

The width of each of the cash cassettes 9 is approximately that of, but less than, the cabinet 11. The front wall 21 is pivotally connected to the bottom wall 29, such as by a hinge 37, whereby the front wall 21 is partially openable outwardly to expose and provide insertion access to an upper panel 39 as shown in FIG. 5, or fully openable outwardly to provide contents removal access to the cavity 31, as indicated by the arrow designated by the numeral 41 in FIG. 12, such that contents contained therein may be readily removed. The upper panel 39 is slotted, having a plurality of slots 43 arranged generally parallel to the front wall 21. Each of the slots 43 has a length sufficient to permit a currency bill to be longitudinally inserted through a respective one of the slots 43.

Each of the cassettes 9 generally has a plurality of vertically oriented dividers 49 such that the cavity 31 is separated into a plurality of bins 51. For example, the cassette 9 may have four of the dividers 49 dividing the cavity 31 into five of the bins 51, as shown in FIG. 12. The dividers 49 may be held in place by welding, retention lugs, or other suitable means. Generally, the dividers 49 are equidistantly spaced apart such that the bins 51 are similarly dimensioned. The front wall 21 generally has a double-wall construction to provide a lightweight structure while retaining desired security. If desired, a plurality of fins 61 attached to the front wall 21 may be configured to be spaced alongside respective ones of the dividers 49 as the front wall 21 assumes a closed configuration, as shown in FIG. 2. A deflector 63 is spaced below each of the slots 43 such that a bill of currency 65 inserted through one of the slots 43 is directed inwardly into the respective bin 51, as indicated by the arrow designated by the numeral 67 in FIG. 6.

Thus a cashier, bank teller or person receiving currency bills of various denominations may insert the bills through a preselected one of the plurality of slots 43, depending on the denomination of the bill, thereby sorting the bills according to denomination. If desired, checks may be kept in one of the compartments or, alternatively, in the drawer 15. Since sorting currency bills is one of the tasks of accounting for the cash receipts, the ability to sort bills in an ongoing manner permits a bank teller, cashier or currency service counter person to allocate her or his time more efficiently than might otherwise be possible.

The system 1 includes a cassette locking arrangement 71, such as a key 73 and tumbler cylinder for example, having a locked configuration wherein a bolt 75 extends upwardly from the front wall 21, as shown in FIGS. 2 and 3, locking the front wall 21 in a closed configuration and preventing access to the slotted upper panel 39. The cassette locking arrangement 71 also has an unlocked configuration wherein the bolt 75 is withdrawn into the front wall, as shown in FIGS. 5 and 6, permitting access to the slotted upper panel 39 as the front wall 21 is tilted outwardly.

Figure 7:
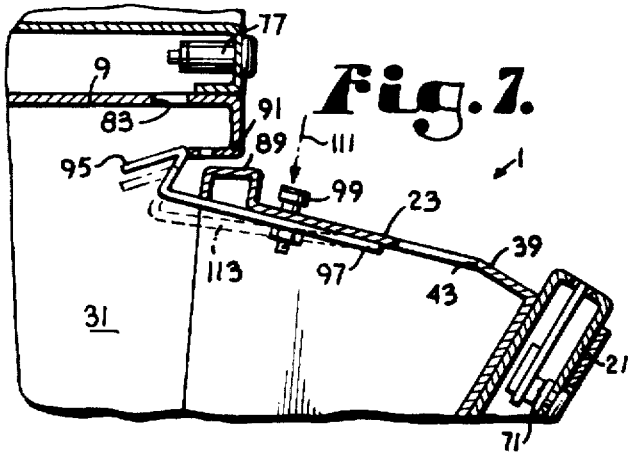
FIG. 7 is a further enlarged and fragmentary, cross-sectional view of the secure currency deposit system, showing a latch and latch release configured to operatively allow contents removal access to one of the multiply accessible cash cassettes.

The system 1 also includes a cavity locking arrangement 77, such as a key 79 and tumbler cylinder for example, having a locked configuration wherein a locking member 81 thereof extends downwardly through a slot 83 in the top wall 23 of the respective cassette 9, as shown in FIG. 4. The cavity locking arrangement 77 also has an unlocked configuration wherein the locking member 81 is withdrawn from the slot 83 in the top wall 23, as shown in FIG. 7. Preferably, the keys 73 and 79 are dissimilar such that the key 73 will not operate the cavity locking arrangement 77 and the key 79 will not operate the cassette locking arrangement 71 for various reasons including those hereinafter described.

As the locking arrangement 77 assumes the locked configuration, the locking member 81 extends sufficiently downwardly such that a rib 89 along the rear of the slotted upper panel 39 abuts thereagainst as the front wall 21 is tilted forwardly to expose the slotted upper panel 39, as shown in FIG. 6, sometimes referred to herein as insertion access. As the locking arrangement 77 assumes the unlocked configuration, the locking member 81 no longer extends into the path of the rib 89. As a result, the rib 89 passes beneath a ledge 91 whereby an unlatching means 93, such as a hook 95 of a resilient latch 97 may bear against the ledge 91, as shown in FIG. 7.

The unlatching means 93 generally includes a release button 99, which is configured such that depression thereof, as indicated by the arrow designated by the numeral 111 in FIG. 7, urges the hook 95 downwardly whereby the hook 95 may pass beneath the ledge 91, as indicated by the dotted lines designated by the numeral 113 in FIG. 7. As a result, the front wall 21 may be fully opened, as shown in FIGS. 8, 9 and 11, whereby access to the cavity 31 is permitted such that contents thereof may be removed therefrom, sometimes referred to herein as contents removal access.

Preferably, the release button 99 is arranged such that it is spaced substantially beneath the ledge 91 as the cavity locking arrangement 77 assumes the locked configuration as shown in FIG. 6, and is spaced in front of the ledge 91 as the cavity locking arrangement 77 assumes the unlocked configuration as shown in FIG. 7.

Alternatively, the unlatching means 93 may include a lever release means 115 having an elbow arrangement 117, as shown in FIG. 14. The lever release means 115 is configured to urge the hook 95 downwardly, as indicated by the arrow designated by the numeral 119 in FIG. 15, as a finger bar 121 spaced within the respective recessed pull 17 is urged upwardly by a user's fingers, as indicated by the arrow designated by the numeral 123. As the finger bar 121 is so urged upwardly, a crossbar 125 across a foot 127 of the lever release means 115 sufficiently urges the resilient latch 97 downwardly, as indicated by the phantom lines designated by the numeral 129 in FIG. 15, whereby the hook 95 can pass beneath the ledge 91.

Upon release of the finger bar 121, the resilient latch 97 returns the lever release means 115 to a latching configuration wherein the hook 95 can no longer pass beneath the ledge 91 from within the cavity 31 unless the unlatching means 93 is reactivated. Note, however, that a distal end 131 of the hook 95 is angled such that as the front wall 21 is being closed, the hook 95 is automatically and physically depressed downwardly allowing the hook 95 to assume the latching configuration within the cavity 31 without having to manually activate the unlatching means 93.

The cavity locking arrangement 77 may serve an additional purpose. If desirable, each of the one or more cassettes 9 may be removable from the cabinet 11 so that it may be carried or transported to a more secure location for opening the respective cassette 9 and removing the contents from the cavity 31 thereof. In that event, as the cavity locking arrangement 77 assumes its locked configuration, removal of the respective cassette 9 from the cabinet 11 is prevented. Similarly, as the cavity locking arrangement 77 assumes its unlocked configuration, removal of the respective cassette 9 from the cabinet 11 is permitted.

Figure 13:
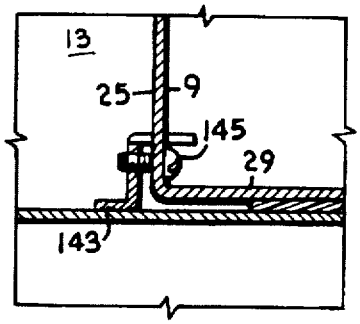
FIG. 13 is a further enlarged and fragmentary, cross-sectional view of the secure currency deposit system showing a bracket for semi-permanently mounting one of the multiply accessible cash cassettes in a cabinet thereof.

Alternatively, the system 1 may provide for any or all of the one or more cassettes 9 to be semi-permanently installed in the cabinet 11. In that event, a mounting bracket 143 appropriately secured to the cabinet 11 may, in turn, be fastened to the respective cassette 9. For example, a bolt or machine screw 145 may be attached to the mounting bracket 143 from within the cavity 31, as shown in FIG. 13. As a result, the respective cassette 9 can only be de-installed from the cabinet 11 by removing the appropriate bolts 145, which obviously requires access to the cavity 31 by authorized personnel.

When removed from the respective compartment 13, the locking member 81 is no longer available to prevent opening of the front wall 21, inadvertently or otherwise. Thus, unless prevented, it is foreseen that as the cavity locking arrangement 71 assumes the unlocked configuration, the front wall 21 could fall open outwardly, causing the hook 95 to be forced past the ledge 91. In that event, at least the contents of the cavity 31 could be spilled. Worse, the front wall 21 could swing downwardly, perhaps injuring the legs of the person carrying the cassette 9.

To prevent that situation, the cassette 9 preferably includes latching means 147 configured to permit removal of the respective cassette 9 from the respective compartment 13 only as the cassette locking arrangement 71 assumes a locked configuration. The latching means 147 includes a latch 149, generally having a Z-shaped configuration as shown in FIG. 16. Resilient means, such as a coiled spring 151, normally maintains the latch 149 in the position shown in FIG. 16 as the cassette locking means 71 assumes its unlocked configuration, such that a distal end 153 thereof extends through openings 155 and 157 and into the cabinet 11 preventing removal of the respective cassette 9 from the cabinet 11.

As the cassette locking means 71 is assuming its locked configuration, the bolt 75 is displaced upwardly, as indicated by the arrow designated by the numeral 159 and as indicated by the phantom lines designated by the numeral 161, urging the latch 149 against the spring 151. In so doing, the distal end 153 is withdrawn from the openings 155 and 157, as indicated by the phantom lines designated by the numeral 163 in FIG. 16, thereby permitting removal of the respective cassette 9 from the cabinet 11.

The locking and latching arrangements, namely the cassette locking arrangement 71 and the cavity locking arrangement 77 in conjunction with the latching means 147, provides a further safeguard if the cassette locking arrangement 71 is keyed differently from the cavity locking arrangement 77. As the cavity locking arrangement 77 assumes its locked configuration with the respective cassette 9 received within its respective compartment 13, the person having the key 73 to the cassette locking arrangement 71 can obtain insertion access to the cavity 31 but cannot obtain content removal access to the cavity and cannot remove the cassette 9 from the cabinet 11. The person having the key 79 to the cavity locking arrangement 77 cannot remove the cassette 9 from the cabinet 11 as the cassette locking arrangement 71 assumes its unlocked configuration.

Similarly, as the cassette locking arrangement 71 assumes its locked configuration, the person having the key 79 to the cavity locking arrangement 77 can remove the cassette 9 from the cabinet 11 but cannot obtain either insertion access or contents removal access to the cavity 31. Thus, when the cassette 9 is removed from the cabinet 11, generally each of the persons having the keys 73 and 79, or a third person having authorization to use one or both of the keys 73 and 79, needs to be present to obtain entry to the contents of the cavity 31.

In other words, each of the cassettes 9 is multiply accessible: insertion access is available to the person having the key 73 to the cassette locking arrangement 71 and, as the cassette locking arrangement 71 assumes the unlocked configuration, contents removal access is available to the person having the key 79 to the cavity locking arrangement 77.

In an application of the present invention, a teller or user may position himself or herself either in front of the cabinet 11 or to one side of cabinet 11, either to the left or the right. Further, two users may have access to the cabinet 11 by one of the users being positioned to the left of the cabinet 11 and the other one of the users being positioned to the right of the cabinet 11. If desired, one or both of the users positioned alongside the cabinet 11 may be seated using the counter top shown in FIG. 1 as a desk-type working surface. If the cabinet 11 contains only one of the cash cassettes 9, then one or both of the users could concurrently use that cassette 9. If two users have access to the same cabinet 11, preferably each would have access to his own separate one of the cassettes 9 in the cabinet 11.

Preferably, each user has the key 73 to his respective cassette locking arrangement 71 but does not have the key 79 to the respective cavity locking arrangement 77. The user may obtain insertion access to his respective slotted upper panel 39 by unlocking the respective cassette locking arrangement 71 when ready to participate in his cash handling transactions. Because he does not have the key 79, the user does not have access to the contents of the respective cavity 31, nor can he remove the cassette 9 from the cabinet 11. Such an arrangement should frustrate attempts to forcibly obtain cash from the user as the user cannot hand over the cash contained in the cassette 9 nor can he hand over the cassette 9 containing the cash. If it is desired to remove cash from the cavity 31, then the person having possession of the key 79 must be available to unlock the cavity locking arrangement 77.

Figure 10:
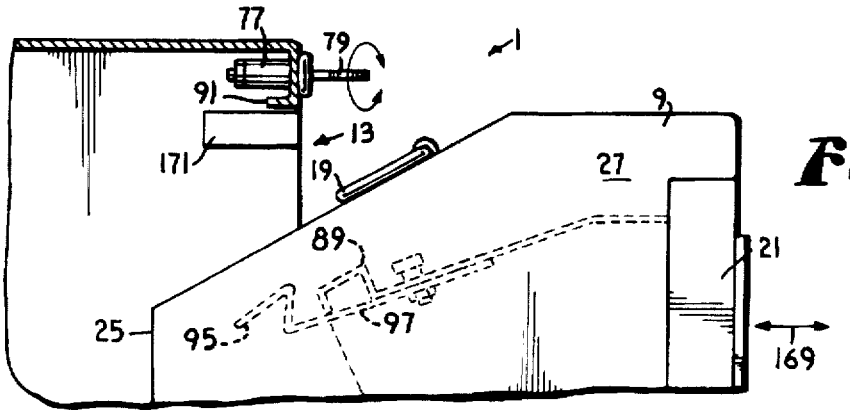
FIG. 10 is a further enlarged and fragmentary, cross-sectional view of the secure currency deposit system showing one of the cash cassettes being removed therefrom.

If the user desires to take a break or otherwise leave the immediate vicinity of his respective cassette 9, he may lock the cassette locking arrangement 71 to prevent access to either the slotted upper panel 39 or to the cavity 31. The cassette 9, however, may be removed from the cabinet 11, as indicated by the arrow designated by the numeral 169 in FIG. 10, and transported to another location by unlocking the cavity locking arrangement 77. If desired, friction resistant means 171, such as a strip of Teflon or other suitable material adhesively attached to appropriate surfaces as indicated in FIGS. 5 and 10, may be used to facilitate ease of removal of the cassettes 9 from the respective compartments 13. The contents of the cassette 9 remain secure, however, until either the user is again present with the key 73 to unlock the cassette locking arrangement 71 or another authorized person is present with one of the keys 73.

Alternatively, if the user desires to take a break or otherwise leave the immediate vicinity of his respective cassette 9, he may leave the cassette locking arrangement 71 unlocked to prevent removal of the cassette 9 to another location during his absence unless, of course, the cassette locking arrangement 71 is locked by another authorized person having one of the keys 73.

It is to be understood that while certain forms of the present invention have been illustrated and described herein, it is not to be limited to the specific forms or arrangement of parts described and shown.

What is claimed and desired to be secured by Letters Patent is as follows:

1. An apparatus for receiving and transporting currency, comprising:

a) an enclosed cassette having an openable front wall, a cavity, and a slotted upper panel configured to operatively receive the currency therethrough for deposit in said cavity;

b) container means having a compartment configured to receive said cassette therein;

c) first locking means for selectively locking said front wall of said cassette; said first locking means having a first configuration wherein insertion access to said slotted upper panel is prevented and a second configuration wherein insertion access to said slotted upper panel is permitted; and d) second locking means for selectively locking said cavity as said cassette is received in said compartment; said second locking means having a third configuration wherein contents removal access to said cavity is prevented and a fourth configuration wherein contents removal access to said cavity is permitted.

2. The apparatus according to claim 1, wherein said second locking means is configured to prevent removal of said cassette from said compartment as said second locking means assumes said third configuration.

3. The apparatus according to claim 1, wherein said second locking means is configured to permit removal of said cassette from said compartment as said second locking means assumes said fourth configuration.

4. The apparatus according to claim 2, including latching means for selectively latching said cassette in said compartment.

5. The apparatus according to claim 4, wherein said latching means has a fifth configuration wherein said latching means is configured to prevent removal of said cassette from said compartment as said first locking means assumes said second configuration.

6. The apparatus according to claim 4, wherein said latching means has a sixth configuration wherein said latching means is configured to permit removal of said cassette from said compartment as said first locking means assumes said first configuration.

7. The apparatus according to claim 1, including unlatching means for selectively unlatching said front wall such that contents removal access to said cavity is permitted as said second locking means assumes said fourth configuration.

8. The apparatus according to claim 7, wherein said unlatching means includes a resilient latch and release means configured to selectively unlatch said resilient latch.

9. The apparatus according to claim 8, wherein said release means includes a release button.

10. The apparatus according to claim 8, wherein:

a) said cassette includes a recessed handle; and b) said release means includes a lever arrangement associated with said recessed handle.

11. The apparatus according to claim 1, including:

a) two of said cassettes;

b) said container means having two compartments, each configured to receive a respective one of said cassettes;

c) two of said first locking means, one associated with each of said cassettes; and d) two of said second locking means, one associated with each of said compartments.

12. An apparatus for handling currency, comprising:

a) at least one removable cash cassette having a cavity, a generally rectangularly shaped front wall and an upper wall extending generally rearwardly from an upper end of said front wall; said upper wall having a plurality of insertion slots configured to operatively receive the currency therethrough for placement in said cavity;

b) a cabinet having at least one forwardly opening compartment configured to operatively receive said at least one cash cassette therein;

c) securing means for releasably securing said at least one cash cassette in said compartment;

d) each cassette comprising a first access means for selectively providing insertion access to said plurality of insertion slots, said first access means comprising said front wall being pivotally connected to said cassette having a first position wherein said insertion access to said plurality of insertion slots is prevented and a second position wherein said insertion access to said plurality of insertion slots is premilled; and e) each pivotally mounted front wall having a futher position wherein said cavity is substantially exposed for selectively providing contents removal access to said cavity.

13. The apparatus according to claim 12, wherein said at least one cash cassette includes a plurality of internal partitions dividing said at least one cash cassette into a plurality of internal bins, each bin being associated and aligned with a respective one of said plurality of insertion slots.

14. The apparatus according to claim 13, wherein said plurality of insertion slots comprises five insertion slots and said plurality of internal partitions comprises four partitions dividing said cavity into five separate bins.

* * * * *